United States Patent [19]

Leech

[11] Patent Number: 4,510,823

[45] Date of Patent: Apr. 16, 1985

[54] DRIVE FOR SHELL TYPE ROLLS

[75] Inventor: Francis Leech, Seymour, Conn.

[73] Assignee: USM Corporation, Farmington, Conn.

[21] Appl. No.: 332,482

[22] Filed: Dec. 21, 1981

[51] Int. Cl.[3] ..... F16H 57/10; B60B 15/16

[52] U.S. Cl. ..... 74/789; 74/410; 74/801; 100/172; 29/115

[58] Field of Search ..... 74/406, 410, 413, 789, 74/797, 801, 803; 29/115, 116 AD; 100/172; 464/98, 99

[56] References Cited

U.S. PATENT DOCUMENTS

| | | | |
|---|---|---|---|
| Re. 27,445 | 8/1972 | Kuehn | 29/116 |
| 1,170,450 | 2/1916 | Lachmann | 464/99 X |
| 2,331,781 | 10/1943 | Hollander | 464/99 X |
| 2,414,134 | 1/1947 | Bartlett | 74/413 |
| 2,676,387 | 4/1954 | McArn | 29/115 |
| 2,908,964 | 10/1959 | Appenzeller | 29/110 |
| 3,094,067 | 6/1963 | Williams | 100/172 X |
| 3,258,995 | 7/1966 | Bennett et al. | 74/801 |
| 3,419,890 | 12/1968 | Justus | 100/172 X |
| 3,552,225 | 1/1971 | Van Voorhis | 74/413 X |
| 3,587,152 | 6/1971 | Hold | 29/116 |
| 3,853,214 | 12/1974 | Vinarcsik et al. | 29/115 X |
| 3,855,681 | 12/1974 | Andriola et al. | 29/115 |
| 3,997,952 | 12/1976 | Lehmann et al. | 29/115 |
| 4,111,065 | 9/1978 | Matikainen et al. | 74/410 |
| 4,271,574 | 6/1981 | Matikainen | 74/801 X |

FOREIGN PATENT DOCUMENTS

| | | | |
|---|---|---|---|
| 53-92071 | 8/1978 | Japan | 464/98 |
| 561330 | 5/1944 | United Kingdom | 74/413 |

*Primary Examiner*—Allan D. Herrmann
*Assistant Examiner*—Joseph M. Rolnicki
*Attorney, Agent, or Firm*—Vincent A. White

[57] ABSTRACT

A drive for a variable crown shell roll in which a driven pinion provides rotary motion to the shell roll through the teeth of a first ring gear which is loosely mounted so as to be rockable about the pinion to accommodate deflection of a second ring gear flexibly carried by the roll shell and which meshes with the second ring gear.

5 Claims, 2 Drawing Figures

DRIVE FOR SHELL TYPE ROLLS

BACKGROUND OF THE INVENTION

1. Field of the Invention

The invention relates to drives for deflectable rolls such as shell type rolls.

2. Description of the Prior Art

Rolls of this type typically include a bendable inner non-rotatable shaft on which a shell roll is mounted for rotation. The inner shaft conventionally is mounted at its ends in pedestals at least one of which also commonly supports a fixed axis gear drive. When a load is applied to the shell roll such as in a calender the inner shaft bends while support means acting between the shaft and the inside of the shell roll maintains the outer surface of the shell roll substantially straight. Such rolls typically are shown in U.S. Pat. No. 2,908,964 to Appenzeller and U.S. Pat. No. 3,587,152 to Hold. During loading of the roll such a support system maintains a uniform nip pressure along the length of the shell roll against a cooperating roll but significant bodily deflection occurs along the fixed shaft. This results in substantial misalignment of the shaft and the shell roll axes. Such misalignment also causes misalignment of the fixed axis gear drive and the deflectable shell roll gearing, which drive must provide substantial power transmission. Typical of loads that must be accommodated may be provided by a rotary power source such as a 300 h.p., 1200 RPM d.c. electric motor.

One solution to the gear misalignment is illustrated in U.S. Pat. No. Re. 27,445 to Kuehn in which the fixed axis portion of the gear drive is supported in a triple race bearing mounted in a fixed pedestal. The deflectable axis part of the gear drive associated with the shell roll is connected to the fixed axis gearing by a flexible gear spline extending therebetween. Another solution is shown in U.S. Pat. No. 3,855,681 to Andriola et al which also involves a flexible gear spline connection to accommodate the gear misalignment. Both of these solutions typically involve relatively complex mechanisms which also accommodate limited misalignment and separation of meshed gear teeth.

SUMMARY OF THE INVENTION

The objects of the invention include the provision of a simple gear drive mechanism capable of transmitting substantial power loads while accommodating considerable deflection of driven and driving elements and while maintaining good meshing engagement of the gear teeth of the power train. To this end, a pedestal provides support through a spherical bearing for the fixed shaft permitting bending of the shaft axis. The pedestal also provides a fixed axis support for a drive pinion. The deflectable shell roll is rotatably mounted on the bendable shaft and carries through a flexible connection a first ring having gear teeth. Arranged between the pinion teeth and the ring teeth is a second ring gear having internal and external gear teeth. The second ring gear is supported only by engagement with the gear teeth of the pinion and the first ring gear. In this manner, deflection of the shell roll and the associated first ring gear relative to the fixed axis pinion causes the second ring gear to rock around the teeth of the pinion without separation of the teeth.

According to one feature the axis of the second ring gear oscillates about the pinion while double helical teeth on the pinion and the second ring gear control axial displacement.

DESCRIPTION OF THE PREFERRED EMBODIMENTS

Figure 1:
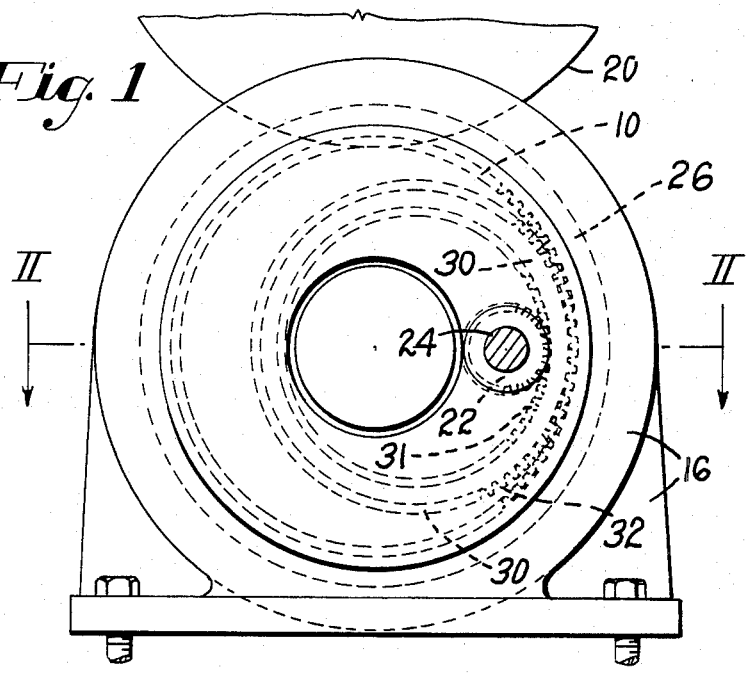
FIG. 1 is an end view of a schematic representation of the gear drive embodying the invention.
Figure 2:
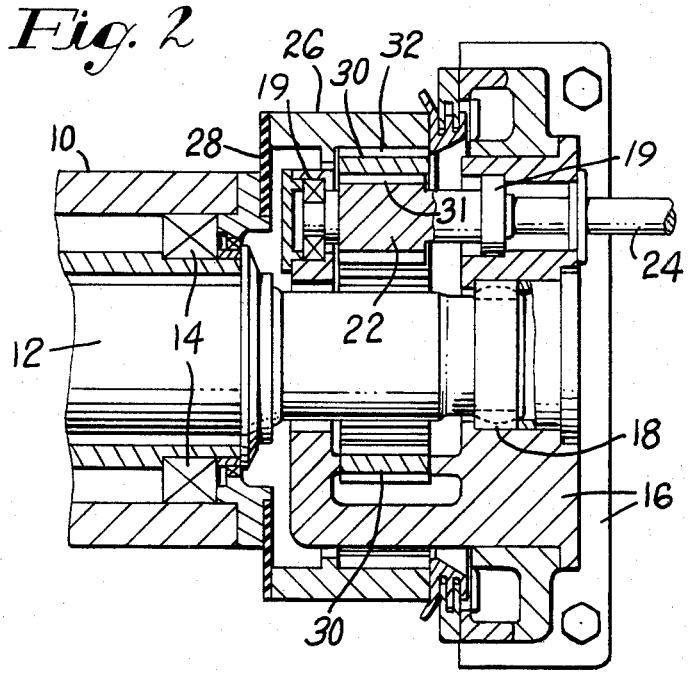
FIG. 2 is a section in plan view taken on line II—II of FIG. 1.

Referring to the drawings there is shown a schematic representation of a shell roll 10 which is mounted at opposite ends for rotation on a fixed shaft 12 by spherical bearings 14 (only one shown). The shaft is supported at opposite ends in pedestals 16 (only one shown) by spherical bearings 18 which permit bending of the shaft as will appear. Only the driven end of the roll assembly is shown and described hereafter but should be sufficient for an understanding of the present invention. When a load is applied to the shell roll such as when closed against a counter roll 20 with a workpiece in between, a uniform nip is maintained between the rolls and the fixed shaft 12 bends between the spherical bearings 18.

To maintain the roll shell in a uniform nip condition, fluid pressure means acts between the inner surface of the shell and the fixed shaft causing the shaft to bend. The fluid pressure means may comprise a fluid pressure chamber between the shaft and the roll shell as in the Appenzeller patent or typically may include a plurality of fluid actuated pistons carried by the shaft and having hydrostatic pads acting against the inner side of the shell as in the Hold patent. Bending of the shaft causes deflection of the roll shell 10 with a resultant misalignment of the axes of the shell and the bearing 18 in the pedestal.

The pedestal 16 through bearings 19 also supports a pinion 22 on a fixed axis. The shaft 24 extending from the pinion is connected to a motor (not shown) so that the pinion forms a driving pinion which typically may transmit substantial rotary torque such as may be provided by a d.c. electric motor of 300 h.p. at 1200 RPM. For driving, the roll shell is provided with a ring 26 having internal gear teeth and being secured to the roll shell by any suitable flexible connection. Preferably, the connection may take the form of a flexible diaphragm 28 to accommodate any non-parallel twisting of the various elements. A ring gear 30 having internal teeth 31 meshing with the pinion teeth and external teeth 32 meshing with the teeth on the ring 26, transmits rotary torque from the driving pinion 22 to the ring 26 and roll shell 10. The ring 30 preferably is supported only by engagement with the pinion 22 and ring 26. Referring to FIG. 1, it may be seen that during deflection of the roll shell 10 and ring 26 the ring gear 30 will be caused to rock bodily around the teeth of the pinion 22 and along the internal teeth of the ring 26. Thus, the axis of rotation of the ring gear 30 oscillates about the teeth of the pinion 22 while the ring gear 30 may be restrained against axial movement by engagement with portions of the pedestal. Preferably, however, the meshing teeth of the pinion and the ring form double helixes also referred to as herringbone teeth to prevent such axial movement.

It should be obvious that without departing from the scope of the invention the driving pinion could be located outside the ring 26 and drive the ring through a floating ring gear which surrounds the pinion. Alternately, of course, the ring gear could surround the ring gear 26 which in either of these alternative forms would be provided with external gear teeth. It should further be obvious that various driving elements such as sprockets and drive chains or pulleys and toothed drive belts could be substituted for toothed gear elements without departing from the scope of the invention defined by the following claims.

I claim:

1. A mechanism for driving a deflectable rotary member including:

a driven pinion;

a support for mounting the pinion for rotation on a fixed axis and for mounting the rotary member on a deflectable axis;

a first ring gear secured to the rotary member;

a second ring gear having internal and external gear teeth supported by meshing engagement between the teeth of the pinion and the first ring gear for rotation about an axis which oscillates bodily according to deflection of the rotary member for maintaining meshing engagement with the teeth of the pinion and the first ring gear.

2. A mechanism according to claim 1 in which the first ring gear has internal gear teeth and the pinion and the second ring are received within the first ring gear.

3. A mechanism according to claim 1 in which the rotary member includes a roll shell mounted for rotation on a fixed flexible shaft mounted in the support.

4. A mechanism according to claim 1 in which the second ring gear rocks along the teeth of the pinion and the first ring gear during deflection of the rotary member for maintaining meshing engagement between the teeth of the pinion and the first ring gear.

5. A mechanism according to claim 2 in which the second ring gear rocks about the teeth of the pinion and along the teeth of the first ring gear during deflection of the rotary member for maintaining meshing engagement with the teeth of the pinion and the first ring gear.

* * * * *